US011866815B2

(12) United States Patent
Yang et al.

(10) Patent No.: US 11,866,815 B2
(45) Date of Patent: Jan. 9, 2024

(54) HIGH ENTROPY ALLOY STRUCTURE AND A METHOD OF PREPARING THE SAME

(71) Applicant: City University of Hong Kong, Kowloon (HK)

(72) Inventors: Yong Yang, Kowloon Tong (HK); Quanfeng He, Kowloon Tong (HK); Zhaoyi Ding, Kowloon Tong (HK)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 17/516,814

(22) Filed: Nov. 2, 2021

(65) Prior Publication Data

US 2022/0056567 A1 Feb. 24, 2022

Related U.S. Application Data

(63) Continuation of application No. 16/151,468, filed on Oct. 4, 2018, now abandoned.

(51) Int. Cl.

| | |
|---|---|
| ***C22F 1/10*** | (2006.01) |
| ***C22F 1/00*** | (2006.01) |
| ***C22C 30/00*** | (2006.01) |
| ***C22C 1/02*** | (2006.01) |
| ***C22C 19/00*** | (2006.01) |

(52) U.S. Cl.
CPC ..... *C22F 1/10* (2013.01); *C22C 1/02* (2013.01); *C22C 30/00* (2013.01); *C22F 1/002* (2013.01); *C22C 19/00* (2013.01)

(58) Field of Classification Search
CPC ..... C22C 30/00
See application file for complete search history.

(56) References Cited

U.S. PATENT DOCUMENTS

2008/0031769 A1* 2/2008 Yeh ..... C22C 19/07 420/580

* cited by examiner

*Primary Examiner* — Keith D. Hendricks
*Assistant Examiner* — Joshua S Carpenter
(74) *Attorney, Agent, or Firm* — Renner, Kenner, Greive, Bobak, Taylor & Weber

(57) ABSTRACT

A method for preparing a high entropy alloy (HEA) structure includes the steps of: preparing an alloy by arc melting raw materials comprising five or more elements; drop casting the melted alloy into a cooled mold to form a bulk alloy; applying an external force against the bulk alloy to reshape the bulk alloy; and heat-treating the reshaped bulk alloy, wherein the bulk alloy is reshaped and/or heat-treated for manipulating the distribution of the microstructure therein. The present invention also relates to a high entropy alloy structure prepared by the method.

16 Claims, 4 Drawing Sheets

HIGH ENTROPY ALLOY STRUCTURE AND A METHOD OF PREPARING THE SAME

TECHNICAL FIELD

The present invention relates to a high entropy alloy structure and a method of preparing the high entropy alloy structure, specifically, although not exclusively, to a high entropy alloy with heterogeneous eutectic microstructures and a method of preparing a high entropy alloy with heterogeneous eutectic microstructures.

BACKGROUND

With respect to the human history, human civilization has striven to develop, discover and invent new materials for more than thousands of years. Since the Bronze Age, alloys have traditionally been developed according to a "base element" paradigm. That is, choosing one or rarely two principle elements such as iron in steels or nickel in superalloys for its properties, and a minor alloying approach to obtain the alloys. The alloys obtained usually have either superior strength or superior ductility. An alloy with high strength may be used in constructing automotive parts such as crossmembers, shock towers, crush cans, etc. whereas an alloy with high ductility may be used in manufacturing tools with various shapes.

BRIEF DESCRIPTION OF THE DRAWINGS

Embodiments of the present invention will now be described, by way of example, with reference to the accompanying drawings in which.

SUMMARY OF THE INVENTION

Figure 1:
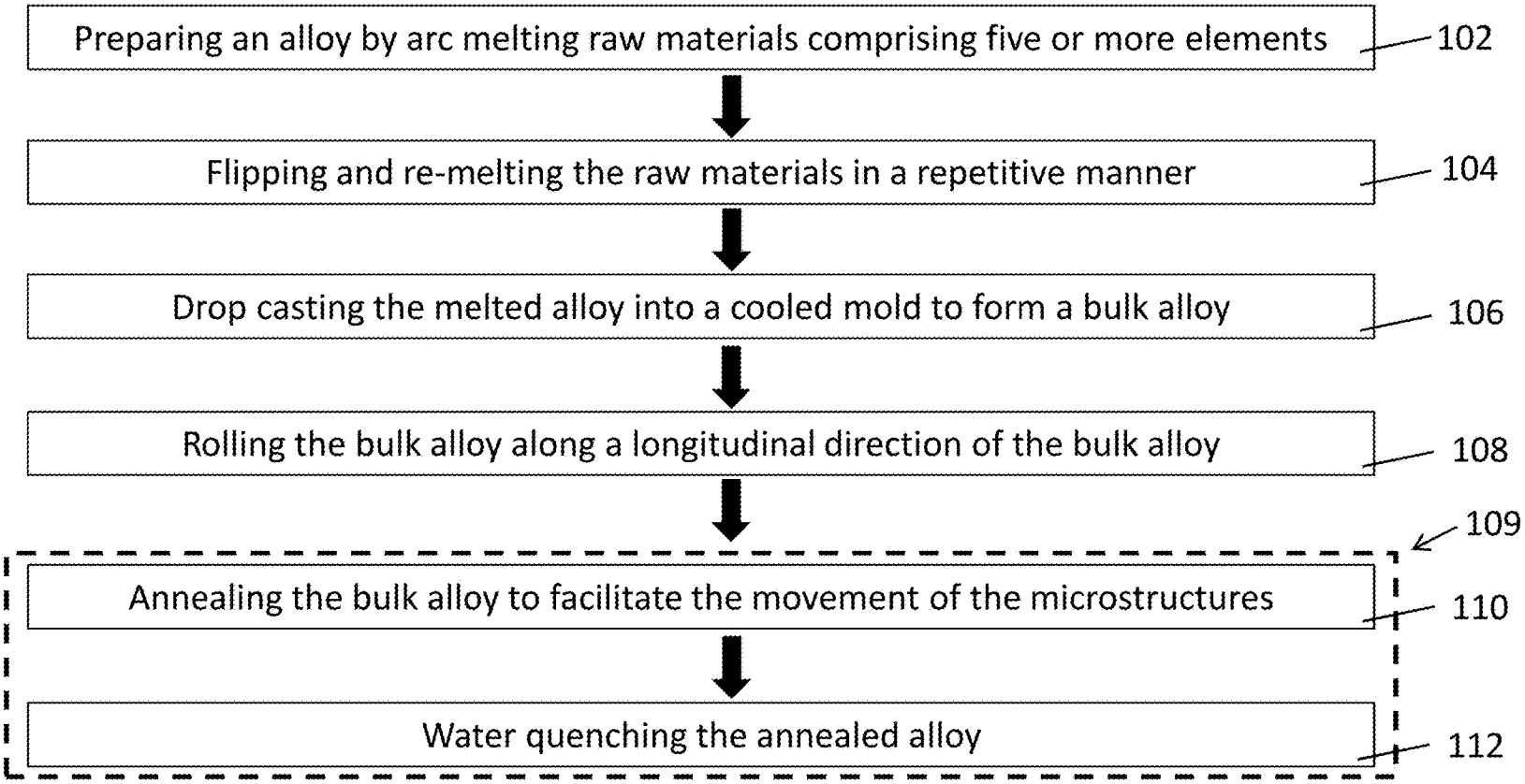
FIG. 1 is a block diagram showing the process flow of a method for preparing a high entropy alloy structure in accordance with one embodiment of the present invention.

In accordance with the first aspect of the present invention, there is provided a method of preparing a high entropy alloy structure comprising the steps of: preparing an alloy by arc melting raw materials comprising five or more elements;

drop casting the melted alloy into a cooled mold to form a bulk alloy; applying an external force against the bulk alloy to reshape the bulk alloy; and heat-treating the reshaped bulk alloy; wherein the bulk alloy is reshaped and/or heat-treated for manipulating the distribution of the microstructure therein;

In an embodiment of the first aspect, step C includes step C1 of rolling the bulk alloy along a first direction to reduce the thickness of the bulk alloy;

In an embodiment of the first aspect, step C1 of rolling is carried out along a longitudinal direction of the bulk alloy;

In an embodiment of the first aspect, the thickness of the rolled bulk alloy is reduced by 70%;

In an embodiment of the first aspect, formed bulk alloy includes a homogenous structure within which the microstructures are uniformly dispersed;

In an embodiment of the first aspect, heat-treated bulk alloy includes a heterogeneous structure within which the microstructures are non-uniformly dispersed;

In an embodiment of the first aspect, the crystals in the microstructure are deformed during the heat treatment in step D to form a plurality of twins;

In an embodiment of the first aspect, step D includes step D1 of heating the bulk alloy to facilitate the movement of the microstructures;

In an embodiment of the first aspect, step D includes step D2, after step D1, of water quenching the heat-treated alloy;

In an embodiment of the first aspect, each of the elements is provided in an atomic percentage of 10% to 30%;

In an embodiment of the first aspect, the elements are Cobalt, Nickel, Chromium, Iron and Aluminum;

In an embodiment of the first aspect, Cobalt, Nickel, Chromium, Iron and Aluminum are provided in an atomic ratio of 30:30:20-0.5x:20-0.5x:x, with X being an integer of 14 to 20;

In an embodiment of the first aspect, the raw materials have a high purity of >99.90%;

In an embodiment of the first aspect, step A includes step A1 of flipping and re-melting the raw materials in a repetitive manner;

In an embodiment of the first aspect, the mold is made of copper;

In an embodiment of the first aspect, the alloy is arc melted within a Ti-gettered argon atmosphere with a pressure below $8\times10^{-4}$ Pa;

In an embodiment of the first aspect, the rolled bulk alloy is annealed at a temperature of at least 800° C. for 6 hours;

In accordance with the second aspect of the invention, there is provided a high entropy alloy structure prepared by the method in accordance with the first aspect;

In an embodiment of the second aspect, the alloy structure includes lamellar structures;

In an embodiment of the second aspect, the size of the lamellar structures is provided in submicron range;

In an embodiment of the second aspect, the alloy structure possesses hardness of 330 to 404 HV;

In an embodiment of the second aspect, the yield stress of the alloy structure is around 850 to 1000 MPa;

In an embodiment of the second aspect, the Young's modulus of the alloy structure is around 230 GPa;

In an embodiment of the second aspect, the alloy structure is thermal stable up to a predetermined temperature of 900° C.;

In an embodiment of the second aspect, the structure is a dual phase eutectic structure; and In an embodiment of the second aspect, the dual phase includes ordered face center cubic (FCC) phase and body center cubic (BCC) phase.

DETAILED DESCRIPTION OF THE PREFERRED EMBODIMENT

High Entropy Alloys (HEAs) are a new kind of alloy typically composed of five or more elements with near equi-atomic ratio and no principal/dominant element. These alloys, however, usually possess relatively a single phase structure, which may lead to a failure in combining different mechanical properties such as strength and ductility.

Without wishing to be bound by theories, the inventors have, through their own research, trials, and experiments, devised a new alloy material, eutectic high entropy alloys (EHEAs) and a method of preparing the same. The EHEAs may contain multiphase structures with submicron ranges. Comparing with conventional eutectic alloys, the EHEAs having a particular structural orientation in each phase may result in a synergistic effect of multicomponents such that optimal mechanical and functional properties may be achieved.

With reference to FIG. 1, there is provided a block diagram showing the process flow of a method for preparing a high entropy alloy (HEA) structure. The method comprises the steps of: preparing an alloy by arc melting raw materials comprising five or more elements; drop casting the melted alloy into a cooled mold to form a bulk alloy; applying an external force against the bulk alloy to reshape the bulk alloy; and heat-treating the reshaped bulk alloy. The bulk alloy is reshaped and/or heat-treated for manipulating the distribution of the microstructure therein As shown, in step 102, an alloy is prepared by arc melting raw materials comprising five or more elements. The raw materials may be independently selected from the elements of groups 4-13 in period 3-6 in the periodic table or the elements of lanthanide series in the periodic table, particularly from the elements of groups 4-13 in period 3-6, preferably from the elements of groups 4-13 in period 3-4.

Most preferably, the raw materials are Cobalt, Nickel, Chromium, Iron and Aluminium. Each of the elements may be provided in an atomic percentage of 10% to 30%. Preferably, the raw materials are provided according to an atomic ratio of 30:30:20-0.5x:20-0.5x:x with x being an integer of 14 to 20. Specifically, the raw materials, Cobalt, Nickel, Chromium, Iron and Aluminum are provided with an atomic percentage of 30%, 30%, 10-13%, 10-13%, and 14-20%. The raw materials may be of a high purity such as >90%, particularly >95%, preferably >99%, most preferably >99.90%.

The aforementioned raw materials may be melted in an arc furnace under an inert atmosphere. Preferably, the arc furnace is pump-filled with Ti-gettered argon gas, for example, 5 times such that the pressure inside the furnace is less than $8\times10^{-4}$ Pa.

During the arc melting in step 102, the raw materials may be flipped and remelted in a repetitive manner in step 104 so as to ensure chemical homogeneity. In other words, to ensure each of the raw material components are uniformly distributed. Preferably, the raw materials are flipped and re-melted for at least five times.

Once the raw materials are completely arc melted, the resultant material, that is the melted alloy, may be drop casted into a cooled mold to form a semi-finished product in step 106. Preferably, the melted alloy may be drop casted into a copper mold cooled with water so as to obtain a bulk alloy. The bulk alloy obtained in step 106 may include a homogeneous structure within which the microstructures are uniformly dispersed.

After obtaining the bulk alloy, the bulk alloy may be reshaped and/or heat-treated in steps 108 and 109 so as to manipulate the distribution of the microstructures. In step 108, the bulk alloy may be reshaped by applying an external force against the bulk alloy. In this step, a rolling process may be carried out to reshape the bulk alloy. The term "rolling" refers to a process of which a bulk metal is passed through one or more pairs of rolls to reduce the thickness of the metal and to make the thickness uniform. In particular, the rolling process may be performed at a temperature above or below the recrystallization temperature of the bulk metal. In other words, the bulk metal may be reshaped by a hot rolling process or a cold process. Preferably, the bulk alloy obtained in step 106 is subjected to a cold rolling process along a longitudinal direction of the alloy. As such, the thickness of the alloy is substantially reduced by, for example, 70%. That is, a rolled alloy with a thickness of which is reduced by 70% after step 108.

The rolled alloy may be subjected to a specific heat treatment 109 so as to further manipulate the distribution of the microstructures therein. The heat treatment involves steps 110 and 112. In step 110, the bulk alloy is annealed to facilitate the movement of the microstructures. To carry out annealing process, the rolled alloy may be heated to at least 800° C., in particular to 800° C. or 900° C. for 6 hours in the furnace. In this way, the crystals in the microstructures may be deformed to form a plurality of twins.

The annealed alloy is then taken out from the furnace and directly quenched with water so as to obtain a bulk alloy with eutectic microstructures therein in step 112. The annealed bulk alloy may include a heterogeneous structure within which the microstructures are non-uniformly dispersed. As such, a stable microstructure may be adopted, which may result in enhanced mechanical and thermal properties for the high entropy alloy.

As mentioned above, the bulk alloy formed in step 106 may have a homogeneous microstructure within which the microstructures are uniformly dispersed. This may be done by systematically varying the Aluminium content (as well as Chromium, Iron) of the alloy. Such variation may also lead to different morphologies to the HEAs prepared. It is aware by the skilled person in the art that the morphologies of the prepared HEAs may be characterized by methods such as scanning electron microscopy (SEM).

With reference to FIGS. 2A to 2D, there are provided the SEM images of HEAs prepared by the method as described above. In this example, the HEAs are as-cast alloy obtained in step 106 without undergoing the reshaping process 108 and heat treatment 109. The HEAs are different from each other by their aluminium contents. Preferably, the HEAs 202, 204, 206 and 208 possess an aluminium content of 14%, 16%, 18%, and 20% by atomic percentage respectively.

Figure 2A:
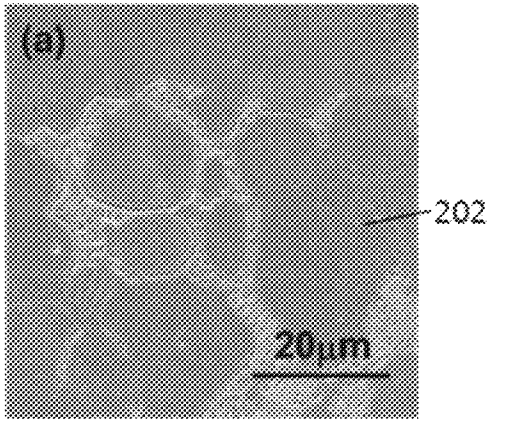
FIG. 2A is a scanning electron microscopy image of an as-cast hypoeutectic high entropy alloy $Co_{30}Ni_{30}Cr_{13}Fe_{13}Al_{14}$ as prepared in accordance with one embodiment.
Figure 2B:
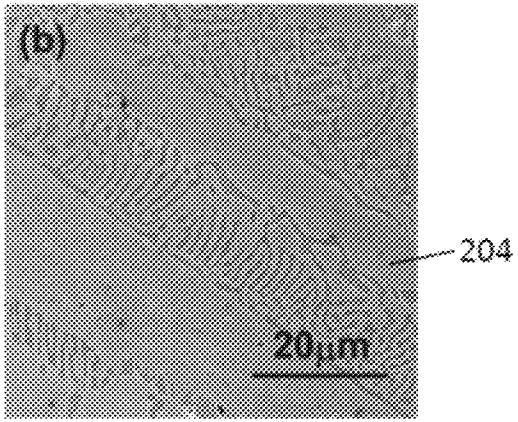
FIG. 2B is a scanning electron microscopy image of an as-cast hypoeutectic high entropy alloy $Co_{30}Ni_{30}Cr_{12}Fe_{12}Al_{16}$ as prepared in accordance with one embodiment.

As shown, the morphologies of the HEAs vary as the aluminium content increases. All the HEA surfaces were occupied with submicron size lamellar structures in different extent. With the lowest aluminium content, the surface of HEA 202 was occupied by a few lamellar structures. There are also some network-like structures connecting the lamellar structure spread through the surface of HEA 202. When the aluminium content increases to 16% by atomic percentage, as shown in FIG. 2B, the network-like structures no longer exists on the surface of HEA 204. Rather, the surface was occupied by lamellar structures arranged regularly, i.e.

the lamellar structures are spaced apart with a predetermined distance. The failure in occupying the whole surface of HEAs 202 and 204 by the lamellar structures may indicate that the HEAs are under a hypoeutectic state.

Figure 2C:
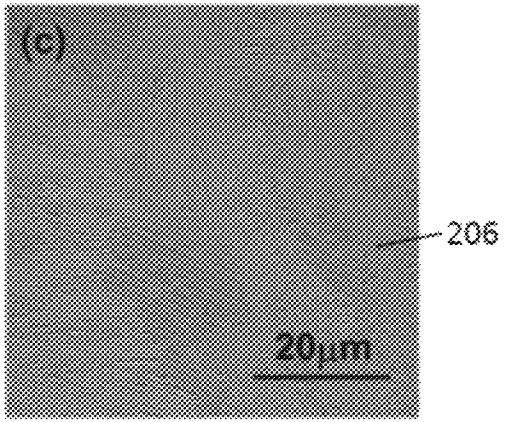
FIG. 2C is a scanning electron microscopy image of an as-cast fully eutectic high entropy alloy $Co_{30}Ni_{30}Cr_{11}Fe_{11}Al_{18}$ as prepared in accordance with one embodiment.
Figure 2D:
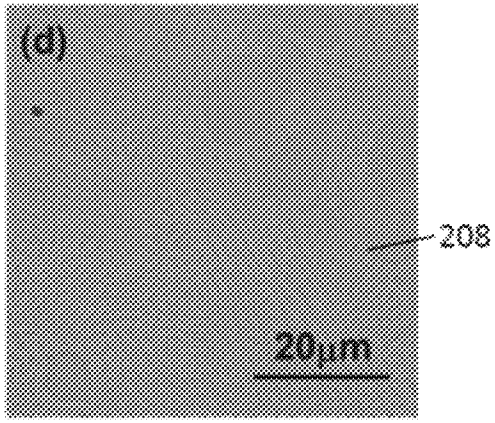
FIG. 2D is a scanning electron microscopy image of an as-cast hypereutectic high entropy alloy $Co_{30}Ni_{30}Cr_{10}Fe_{10}Al_{20}$ as prepared in accordance with one embodiment.

With the aluminium content increased up to 18%, the surface of HEA 206 was fully occupied by the lamellar structures. As shown in FIG. 2C, the orientation of the lamellar structures does not follow a particular direction as compared with those in FIG. 2B. In other words, the lamellar structures of HEA 206 are oriented in all directions. This characteristic may indicate that the HEA 206 is under a fully eutectic state. Nevertheless, any further increase in the aluminium content, for example, to 20% by atomic ratio may lead to a negative effect on the formation of lamellar structures on the HEA surface. As shown in FIG. 2D, although the surface of HEA 208 was still mostly occupied by lamellar structures, the structures were more loosely packed as compared with those in FIG. 2C. In addition, there were some porous areas located within the lamellar structure network. This feature may be an indicator that the HEA 208 is under a hypereutectic state. Advantageously, the lamellar structure of the HEAs 202, 204, 206 and 208 is not substantially affected by the reshaping process 108 or the heat treatment 109.

It is believed that due to the high entropy effect at equal or near-equal atomic ratios, the multicomponents in HEA may tend to form single phase structures, which may render the HEA lack of desire properties.

Figure 3:
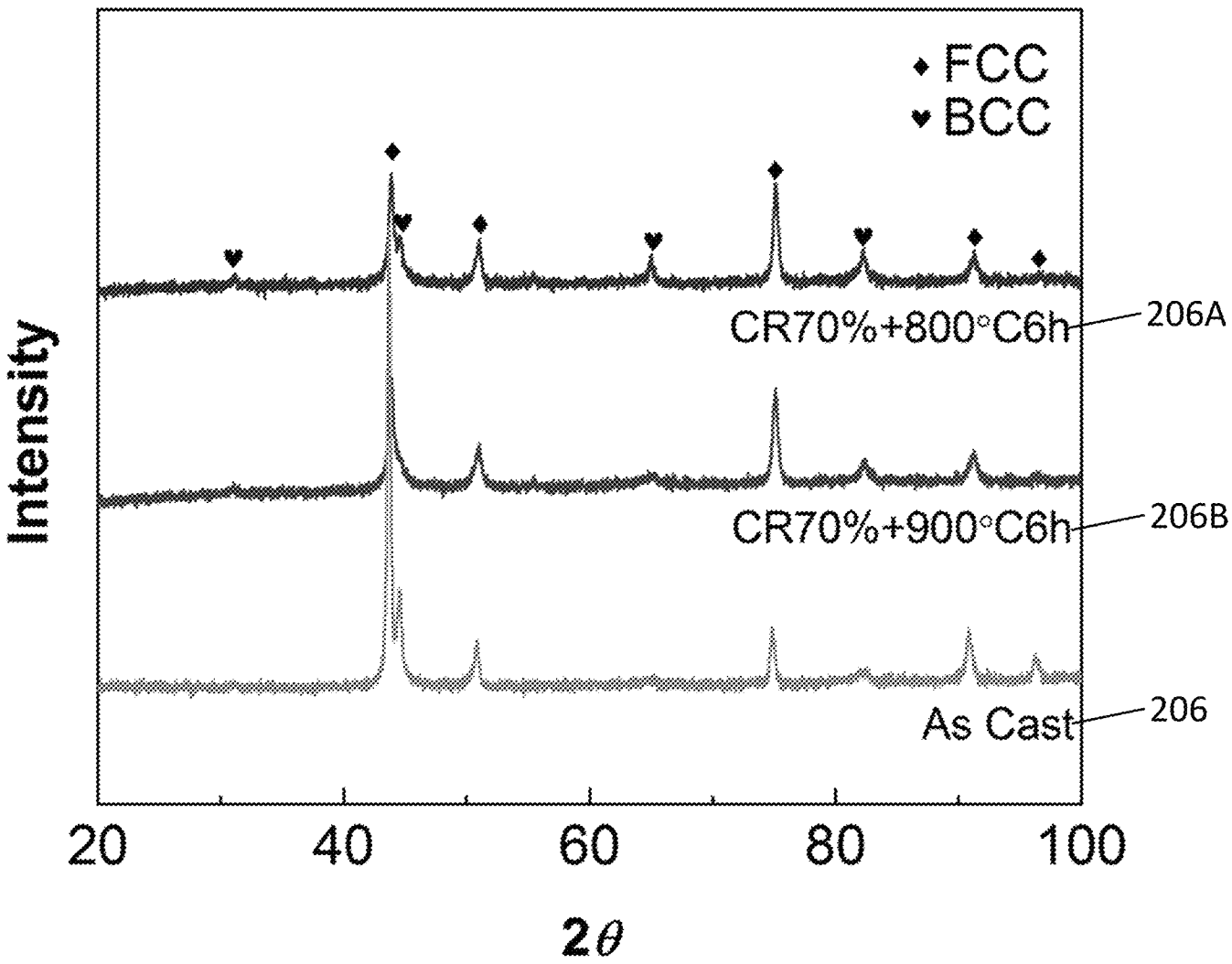
FIG. 3 is an X-ray diffraction diagram showing the X-ray diffraction patterns of the fully eutectic high entropy alloys $Co_{30}Ni_{30}Cr_{11}Fe_{11}Al_{18}$ as prepared in accordance with one embodiment.

Without wishing being bound by the theories, the inventors devised that the HEA prepared by the aforementioned method possesses multiphases particularly dual phases. With reference to FIG. 3, there is provided an X-ray diffraction diagram showing the X-ray diffraction pattern of the HEA structures of the aforementioned embodiments. As shown, the as-cast HEA 206 possesses a dual phase structure, namely ordered face centre cubic (FCC) and body centre cubic (BCC) phases. Importantly, even after the HEA 206 subjected to the reshaping process 108 and heat treatment 109, the structure phases of the resultant HEAs 206A and 206B remained unchanged.

Advantageously, by having two or even more phases as well as undergoing reshaping and heat-treatment, the HEAs of the present invention may have an excellent mechanical strength such as high strength, hardness, and ductility, and thermal stability.

In one embodiment, the hardness of the HEAs may be provided in a range of 330 to 404 HV. In other words, the hardness of the HEAs may be provided as high as 404 HV. It is aware by the skilled person in the art that the hardness measurement may be carried out with a microhardness tester. In other embodiment, the HEAs may be thermal stable up to a predetermined temperature of 900° C. That is, the microstructure of HEAs is stable up to 900° C.

Figure 4:
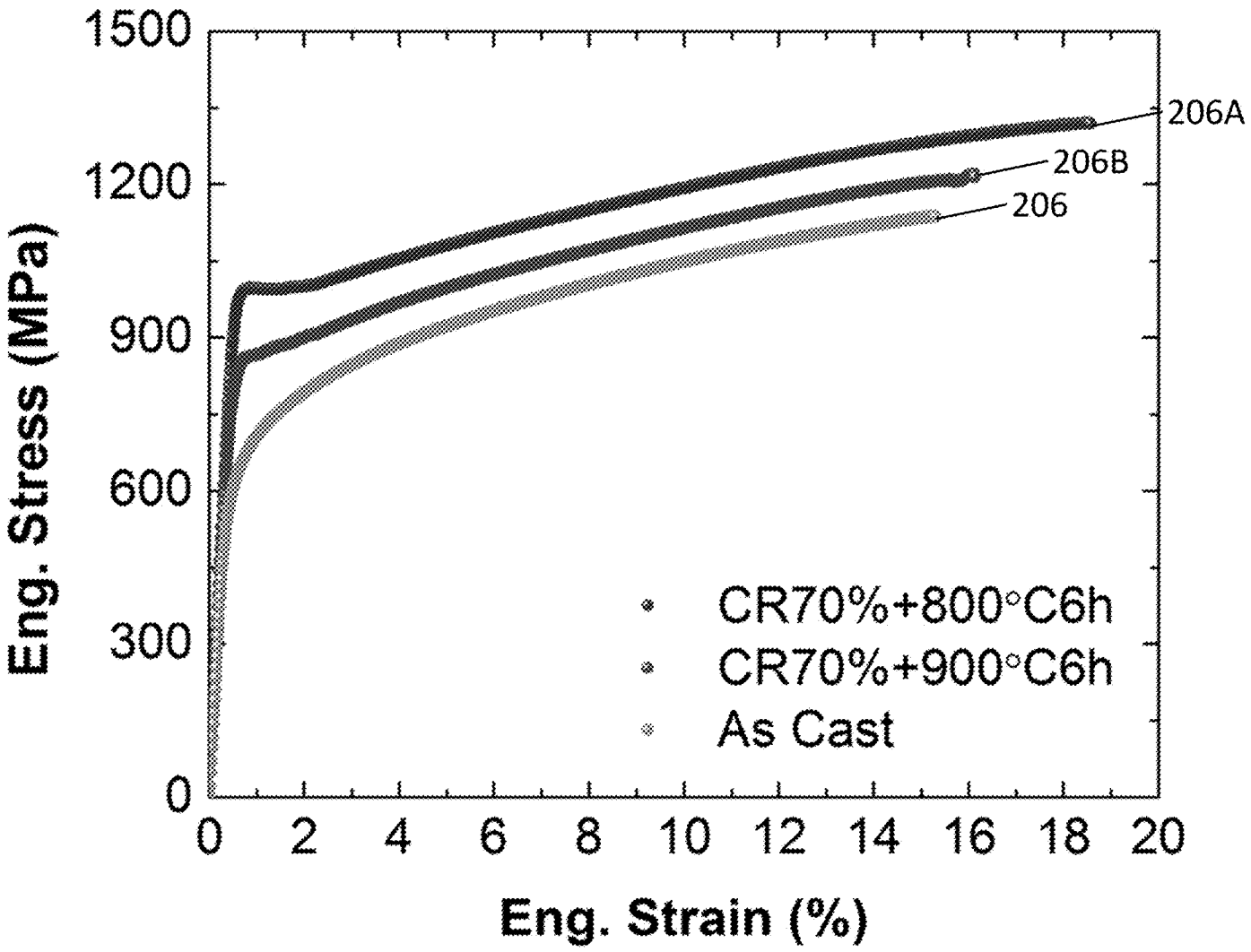
FIG. 4 is a plot of engineering stress against engineering strain showing the tensile engineering stress-strain curves of the fully eutectic high entropy alloys $Co_{30}Ni_{30}Cr_{11}Fe_{11}Al_{18}$ as prepared in accordance with one embodiment.

With reference finally to FIG. 4, there is provided a plot of engineering stress against engineering strain showing the tensile engineering stress-strain curves of the HEAs as prepared by the aforementioned method. It is appreciated that upon a force is applied to a material, the material may undergo different deformation modes (i.e. change in shapes and/or size in different manner). The material may first undergo a reversible deformation, namely elastic deformation in response to the applied force. During this process, the original shape and size of the material may be temporarily changed when a force is applied and may be restored when the applied force is removed. This reversible deformation may continue upon the applied force increases until a threshold is reached, namely yield stress.

Beyond such a yield point, the original shape and size of the material may no longer be restored even the applied force is removed. In other words, the deformation becomes irreversible and in turn the material permanently stays at a particular shape and/or size. The thus-process refers as plastic deformation. Preferably, a material with high strength may have a high yield stress and/or Young's modulus whereas a material with high ductility may have a high fracture point (i.e. the engineering strain at which the material becomes fracture).

Referring to FIG. 4, the as-cast HEA 206 and HEAs 206A and 206B reshaped and annealed at 800° C. or 900° C. respectively displayed an elastic deformation behaviour upon external force is applied. Each of the HEAs has a yield stress of around 850 to 1000 MPa and a Young's modulus of 230 GPa. In particular, the yield stresses of the reshaped and annealed HEAs 206A and 206B were determined to be higher than that of the as-cast HEA 206. Beyond the yield stress, the HEAs underwent plastic deformation and eventually fractured at around 15 to 19% of the engineering strain. Similarly, it is determined that the fracture point of the reshaped and annealed HEAs 206A and 206B were higher than that of the as-cast HEA 206. All these results suggest that the reshaping process and heat treatment may contribute to the relatively higher strength and ductility of the HEAs 206A and 206B, as well as the formability of the HEAs 206A and 206B i.e. the plastic deformation capacity without being damaged such as tearing or fracture.

In one embodiment, the inventors have, through their own research, trials, and experiments, devised that the lamellar structure of the aforementioned reshaped and annealed HEAs may become heterogeneous. In addition, the ordered FCC phase may be transformed into FCC structures. During the deformation process, a high density of deformation twinning was formed as a result of a low stacking energy of the FCC phase. As such, a higher strength and ductility may be obtained in view of the synergistically effect of the heterogeneous structure and the occurrence of deformation twinning.

The present invention is advantageous in that by subjecting the HEAs to a reshaping process and a heat treatment, the microstructures therein may be manipulated which in turn providing an excellent strength and ductility, good thermal stability as well as oxidation resistance, high fluidity and good formability. With these properties, on one hand, the HEAs may be easily processed into different engineering components or used as structure materials. On the other hand, due to the low stacking fault energy of the FCC phase, the deformation twinning would be prevailed when the HEAs were deformed at low temperature, which in turn making the HEAs suitable for the application in the cryogenic field or low temperature applications. The HEAs also possess high fluidity and castability which make them possible for large-scale production. In addition, the method of the present invention involves easy and inexpensive procedures.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. A high entropy alloy structure comprising cobalt, nickel, chromium, iron, and aluminum, in an atomic ratio of 30:30:20-0.5x:20-0.5x:x, wherein x is an integer from 14-20, and wherein the high entropy alloy structure comprises a eutectic high entropy alloy structure.

2. The high entropy alloy structure according to claim 1, wherein the high entropy alloy structure comprises lamellar structures.

3. The high entropy alloy structure according to claim 1, wherein the high entropy alloy structure possesses a hardness of from 330 HV to 404 HV.

4. The high entropy alloy structure according to claim 1, wherein the yield stress of the high entropy alloy structure is from 850 to 1000 MPa.

5. The high entropy alloy structure according to claim 1, wherein the Young's modulus of the high entropy alloy structure is 230 GPa.

6. The high entropy alloy structure according to claim 1, wherein the high entropy alloy structure is a dual phase eutectic structure.

7. The high entropy alloy structure according to claim 1, wherein the high entropy alloy structure comprises a microstructure, wherein the microstructure comprises a plurality of crystals, and wherein the plurality of crystals comprises a plurality of twins.

8. The high entropy alloy structure according to claim 1, wherein the high entropy alloy structure comprises a microstructure, and wherein the microstructure is a uniformly-dispersed, homogenous microstructure.

9. The high entropy alloy structure according to claim 2, wherein the size of the lamellar structures is in a submicron range.

10. The high entropy alloy structure according to claim 6, wherein the dual phase eutectic structure comprises an ordered face center cubic (FCC) phase and a body center cubic (BCC) phase.

11. A method of preparing a high entropy alloy structure comprising the steps of:

A) preparing a melted alloy by arc melting raw materials comprising five or more elements;

B) drop casting the melted alloy into a cooled mold to form a bulk alloy;

C) applying an external force against the bulk alloy to reshape the bulk alloy; and D) heat-treating the reshaped bulk alloy;

wherein the bulk alloy is reshaped and/or heat-treated for manipulating the distribution of the microstructure therein; and wherein the high entropy alloy structure comprises cobalt, nickel, chromium, iron, and aluminum, in an atomic ratio of 30:30:20-0.5x:20-0.5x:x, wherein x is an integer from 14-20, and wherein the high entropy alloy structure comprises a eutectic high entropy alloy structure.

12. The method according to claim 11, wherein step C includes step Cl of rolling the bulk alloy along a first direction to reduce the thickness of the bulk alloy.

13. The method according to claim 11, wherein crystals in the microstructure are deformed during the heat treatment in step D to form a plurality of twins.

14. The method according to claim 11, wherein step D includes step D1 of heating the reshaped bulk alloy to facilitate the movement of the microstructures.

15. The method according to claim 11, wherein step A includes step A1 of flipping and re-melting the raw materials in a repetitive manner.

16. The method according to claim 11, wherein the arc melting is performed within a Ti-gettered argon atmosphere with a pressure below $8\times10^4$ Pa.

* * * * *